United States Patent [19]

Bodine

[11] Patent Number: 4,778,279

[45] Date of Patent: Oct. 18, 1988

[54] SONIC AGITATOR WITH MULTI PHASED VIBRATION BARS

[76] Inventor: Albert G. Bodine, 7877 Woodley Ave., Van Nuys, Calif. 91406

[21] Appl. No.: 87,425

[22] Filed: Aug. 20, 1987

[51] Int. Cl.[4] ..... B01F 11/00

[52] U.S. Cl. ..... 366/118; 366/123; 366/128; 366/600

[58] Field of Search ..... 366/117, 118–123, 366/124, 128, 261, 600, 242; 74/87; 310/81; 422/127, 281

[56] References Cited

U.S. PATENT DOCUMENTS

| | | | |
|---|---|---|---|
| 2,376,221 | 5/1945 | Baker | 366/118 |
| 2,832,572 | 4/1958 | Meng | 366/118 |
| 3,680,841 | 8/1972 | Yagi et al. | 366/118 |
| 4,566,800 | 1/1986 | Bodine | 366/118 |

*Primary Examiner*—Timothy F. Simone
*Attorney, Agent, or Firm*—Edward A. Sokolski

[57] ABSTRACT

Three or more (preferably an even number) of hollow vibration bars are joined together at one end thereof with the bars spaced from each other and with their longitudinal axes in substantially parallel relationship. Each of the bars has an unbalanced rotor mounted therein which when rotatably driven will generate vibrational energy in the associated bar. The similar rotors of the bars are phased with relationship to each other to generate a combined vibrational force pattern in a liquid in which the bars are immersed which affords optimum agitation of the liquid in an omnidirectional manner. The vibration at the juncture between the multiple bars is kept at a minimum by virtue of the cancellation of the force vectors generated by the bar members at this point.

6 Claims, 6 Drawing Sheets

2A
2B
11a
11b
11c
11d
12
14
16
18
20
20a
22a
22b
22c
22d
23
24
25
26
26a
26b
26c
26d
28
30a
30b
30c
30d
31a
31b
31c
31d
32
36
37

SONIC AGITATOR WITH MULTI PHASED VIBRATION BARS

This invention relates to the sonic agitation of liquids in processes such as ore leaching, fluid mixing, liquid cavitation processes, chemical agitation and the like and more particularly to a method and apparatus of this type employing multiple elastically vibrational bar members having cooperatively phased vibrational outputs and which are joined together at one end thereof whereat the vibrational energy is kept substantially quiescent.

Sonic energy can be used to advantage by sonically agitating the liquid employed in such processes as ore leaching, fluid mixing, liquid cavitation processes, chemical agitation and the like. An example of such use of sonic energy is described in my U.S. Pat. No. 4,566,800 issued Jan. 28, 1986 and my U.S. Pat. No. 3,525,606 issued Aug. 25, 1970. In such prior art systems, a single vibrational bar is employed. The system of the present invention affords a significant improvement over such prior art vibrational systems by employing multiple bar members and thereby optimizing the vibrational pattern provided to the liquid and enabling the minimization of vibrational energy at the common joinder point between the multiple bar members, whereat the bar members may be supported and appropriate seals provided without the undesirable effects of vibrational energy at this location.

This improved end result is achieved by joining the multiple elastic bar members together at one end thereof with such bar members being spaced from each other with their longitudinal axes in substantially parallel relationship. The bar members may be hollow in configuration and have similar eccentric rotors rotatably supported therein, thereby forming orbiting mass oscillators which generate vibrational energy in a quadrature vibrational mode in the bar members. The rotors are phased with respect to each other so as to provide an omnidirectional vibrational pattern from the combined outputs of the bar members. The liquid body between the bars can be thus violently squeezed and expanded by opposed motion of the bars. This phasing also operates to effectively cancel out vibrational energy by opposition at the location of the joinder between the elastic bar members, thereby assuring that this location will remain quiescent which facilitates the mounting of drive components for the bar members such as gear boxes, seals, etc. The phasing between the rotors can also be adjusted, such that a "pinching" type cyclical pumping action of the fluid between pairs of bar members may be provided to thoroughly circulate the liquid and enhance the sonic treatment process.

It is therefore an object of this invention to improve the sonic treatment of liquids.

It is a further object of this invention to provide a sonic treatment system employing multiple vibrational bar members which generate vibrational outputs in a predetermined phased relationship to provide an omnidirectional vibrational pattern and a pumping action which circulates the liquid.

It is still a further object of this invention to provide a sonic system for treating liquid which employs multiple vibrational bar members wherein the vibrational energy in the bar members is phased to as to maintain the vibration in quiescence at an end of the bar members where they are joined together.

Other objects of the invention will become apparent as the description proceeds in connection with the accompanying drawings of which:

Figure 1:
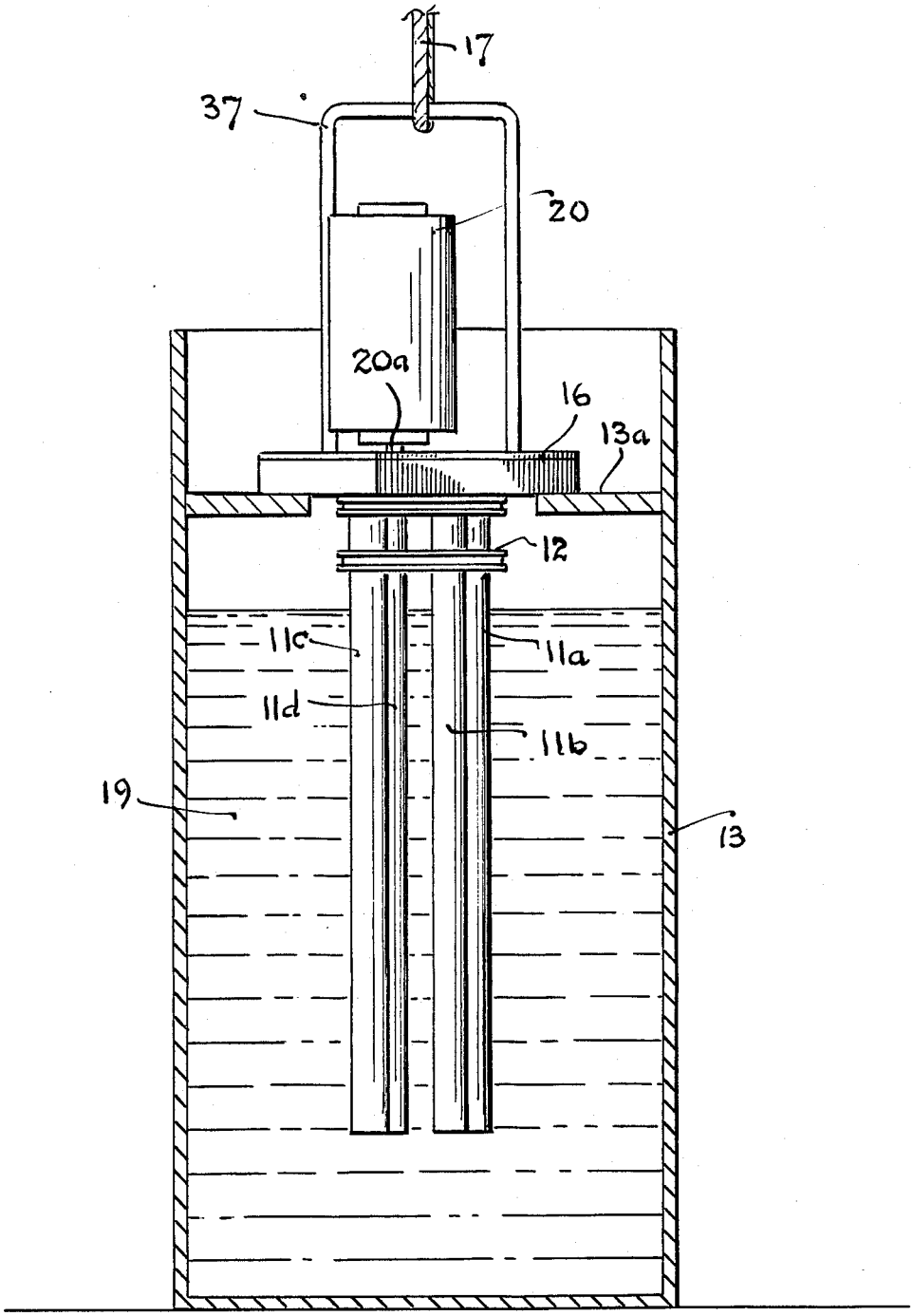
FIG. 1 is a schematic drawing illustrating the use of the system of the invention in treating a liquid.

Referring now to FIG. 1 an embodiment of the invention as employed to agitate a liquid, such as in the leaching of ore, is illustrated. Hollow bar or pipe members **11*a*–11*d* are joind together near one end thereof by means of plate member 12 to which they may be furnace brazed or welded. Bar members 11*a*–11*d* are spaced from each other with their longitudinal axes in substantially parallel relationship. Contained within each of hollow bar members 11*a*–11*d* is a similar rotor member which, as to be explained further on in the specification in connection with FIG. 2, may be in the form of a half moon shaped weighted member. Bar members 11*a*–11*d* are fabricated of an elastic metal such as steel. As to be explained fully in connection with FIG. 2, the rotors of each of bar members 11*a*–11*d* is rotatably driven by means of a drive shaft contained within each bar member which is coupled to a gear contained within gear box 16. The gears of gear box 16 are interconnected in a predetermined manner and rotatably driven by means of electrical motor 20. The entire assembly is suspended by means of flange 13*a* or by cable 17 within liquid 19 which may comprise a leaching solution containing ore to be leached within container 13. The rotors of bar members 11*a*–11*d* are phased with respect to each other such that an omnidirectional vibrational pattern is generated by virtue of the combination of the vibrational outputs of all four bar members. Further, the phasing of the rotors is such as to effect a cancellation of the vibrational energy at the location of the joinder to plate member 12 such that vibration at this region is quiescent, such as for convenient support by flange 13*a***.

Figures 2, 2A, 2B, 2C:
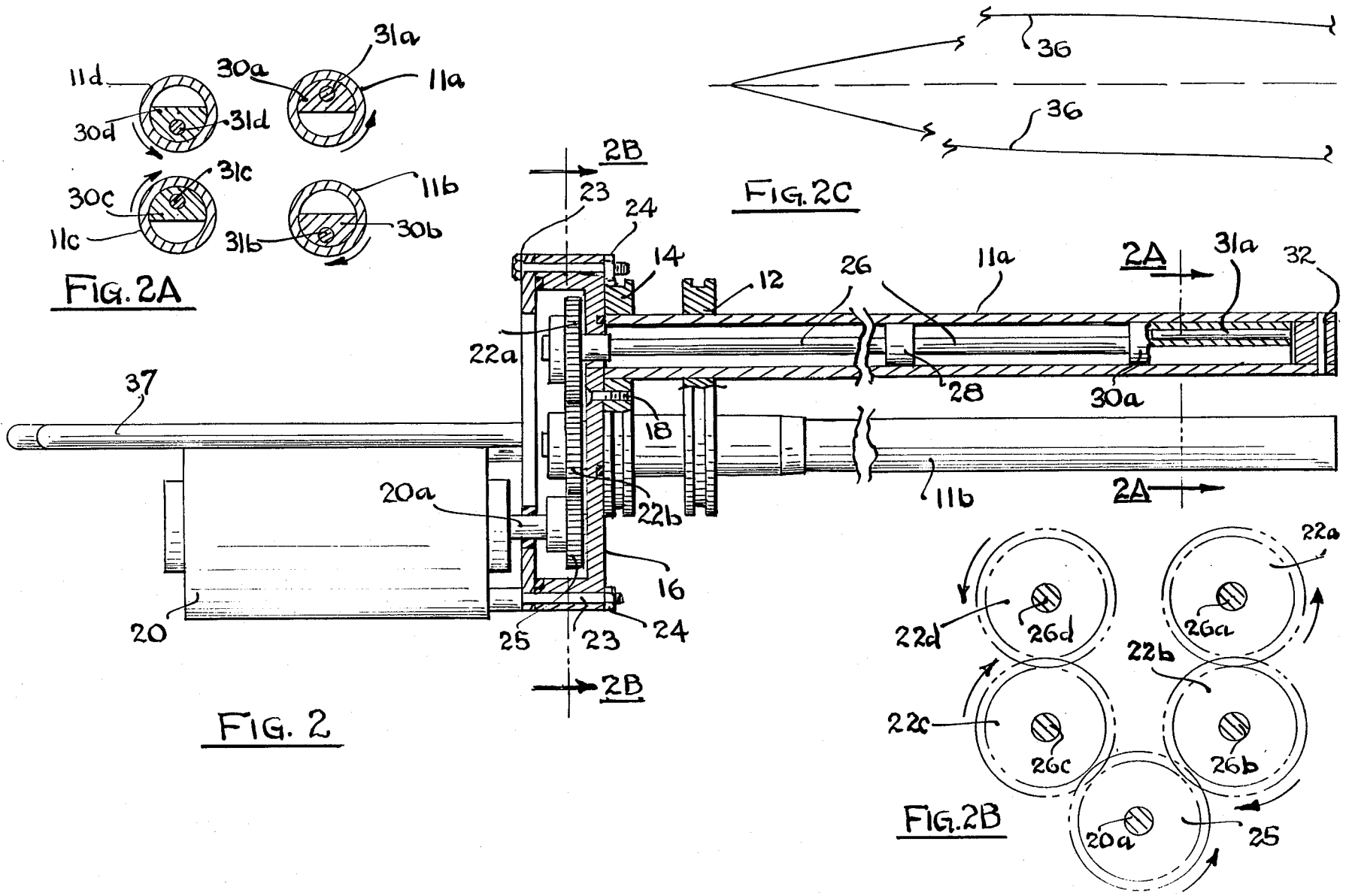
FIG. 2 is a side elevational view of a first embodiment of the invention shown partially in cross section.
FIG. 2A is a cross sectional view taken along the plane indicated by 2A—2A in FIG. 2.
FIG. 2B is a cross sectional view taken along the plane indicated by 2B—2B in FIG. 2.
FIG. 2C is a schematic representation of the vibration pattern set up in the bars.

Referring now to FIGS. 2, 2A, 2B and 2C, a first embodiment of the invention is illustrated. Tubular bar members **11*a*–11*d* are fixedly joined to plate assembly 12 and plate assembly 14 by suitable means such as brazing. Plate assembly 14 in turn is attached to gear box 16 by means of bolts 18. The gear box cover and motor 20 are held to the gear box by means of bolts 23 and nuts 24. The drive shafts 26 are spaced from the inner walls of their bar members by means of guide nodules 28. Eccentric rotors 30*a*–30*d* which are half moon shaped are fixedly attached to the ends of their respective elastic shafts 26, each rotor having a heavy metal insert 31***a*–31*d* therein respectively, to increase the centrifugal force thereof. Contained within gear box 16 and respectively coupled to each of shafts 30*a*–30*d* is a respective gear 22*a*–22*d*. The gears are intermeshed as shown in FIG. 2B, forming two gear trains (25, 22*b*, 22*a* and 25, 22*c*, 22*d*) and the two separate gear trains thus formed are rotatably driven by means of gear 25 which is coupled to the drive shaft 20*a* of electric motor 20. The rotors are phased with respect to each other as shown in FIG. 2A and are rotatably driven about in their respective bar members on the inner walls of the bar members which form sleeve bearings therefor. A handle member 37 is provided for use in handling or in suspending the assembly from a cable or the like in the liquid to be agitated. The rotatably driven rotors generate quadrature elastic vibrations in each of the bar members with an effective vibrational pattern as indicated by graph lines 36 in FIG. 2C. The combined vibrational energy of the four elastic bar members effectively balances out to produce a node or quiescent vibration point at the location of the joinder between the bar members, this by virtue of the effective cancellation of the vibrational energy at this point in view of the phase differences in the vibrational patterns in the different bar members somewhat like a tuning fork.

Figure 3A:
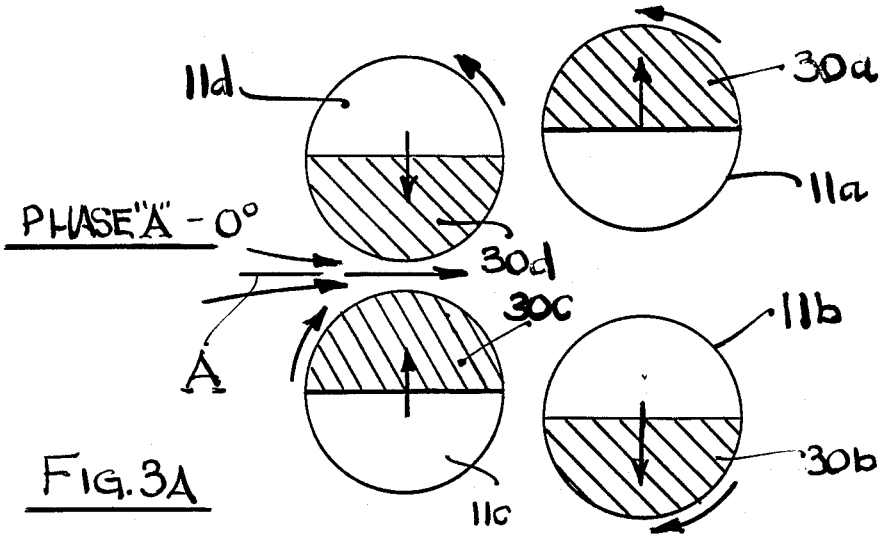
FIGS. 3A–3C are a series of schematic drawings illustrating the phasing of the rotors in the embodiment of FIG. 2.
Figure 3B:
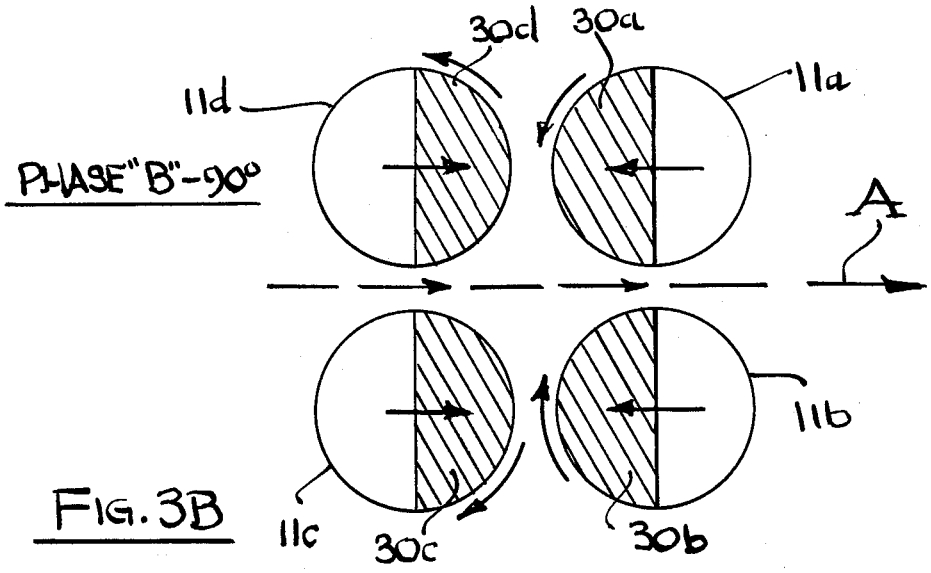
Figure 3C:
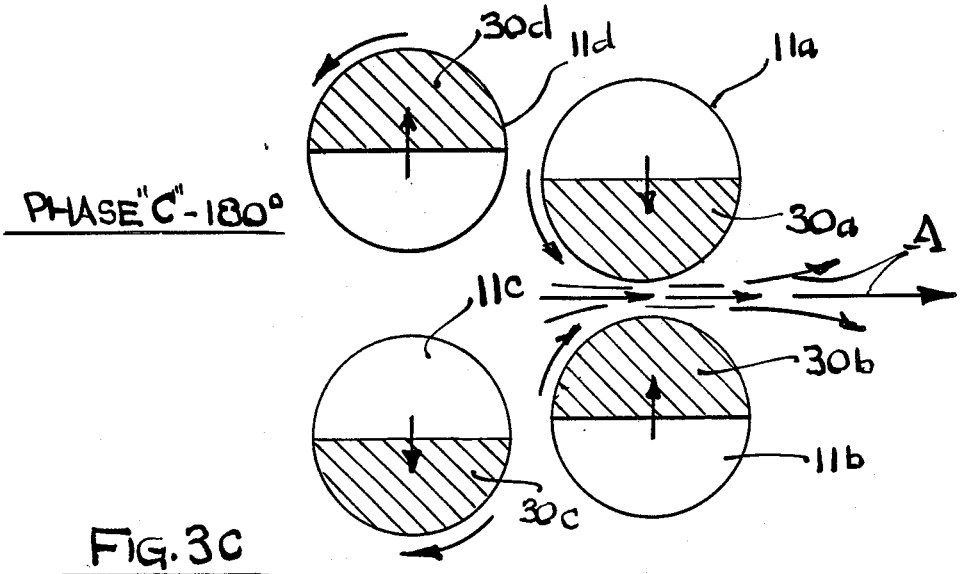

Referring now to FIGS. 3A–3C, the effect of the phasing of the rotors relative to each other in the embodiment of FIG. 2 is illustrated. FIG. 3A shows the rotors in an initial position which is arbitrarily designated as "zero degrees"; FIG. 3B shows the rotors at "90 degrees" and FIG. 3C shows the rotors at "180 degrees".

With the rotors in the position of FIG. 3A, rotors 30*c* and 30*d* cause the bar members to bend around and towards each other while rotors 30*a* and 30*b* cause their respective bar members to bend apart with the liquid effectively being squeezed around between the bar members 11*c* and 11*d* of rotors 30*c* and 30*d* and propelled as indicated by arrows A.

With the rotors in the position indicated in FIG. 3B, the bars of both pairs of rotors 30*a*, 30*b* and 30*c*, 30*d* are neither being driven towards or away from each other, the fluid being permitted to coast through between the bars. With the rotors in the position indicated in FIG. 3C, the bars of rotors 30*a* and 30*b* are being driven around and towards each other while the bars of rotors 30*c* and 30*d* are being driven apart providing a squeezing propelling motion to the fluid "A", adding to the momentum provided during the phase illustrated in FIG. 3A. The cooperative pumping action thus produced aids in bringing the liquid into and through the high sonic energy density field between the paired bars tending to circulate the liquid and subjecting it to concentrated sonic energy pulses in a highly efficient manner. It is to be noted that in addition to this pumping action, sonic energy is continually radiated by the bar members to agitate the liquid. Thus, the liquid is continually being subjected to sonic energy in an omnidirectional vibration pattern while it is being "pinched" in a pumping action between the bar members to effect circulation of the liquid, so that all portions thereof are subjected to the sonic energy.

It is to be noted that whether or not the oscillators are operated at a resonant elastic frequency of the bar members, a nodal point appears where the bar members are joined together as indicated in FIG. 2C by graph lines 36. This is in view of the inherent counter balancing effect provided by the multi-element elastic "tuning fork" formed by the bar members. It is further to be noted that a four bar arrangement is not essential to achieve the operation of the invention. Other numbers of bars in excess of two will operate to provide the desired end results. It is convenient, however, to use an even number of bars to provide pairs thereof to achieve an effective counterbalancing.

Referring now to FIGS. 4, 4A, 4B and 4C, a second embodiment of the invention is illustrated. This embodiment differs from the first embodiment in that it employs a separate motor for driving each of the oscillators and in that it employs an oscillator employing rotors having rollers which are freely mounted to minimize fluid rotor drag, as described in my application Ser. No. 446,662 filed May 1, 1987.

Hollow bar members 11*a*–11*d* which are generally similar to those of the prior embodiment are joined together at their upper ends whereat they are brazed to plate member 45. Mounted for rotation within each of bar members 11*a*–11*d* is a respective rotor member 30*a*–30*d*. Such rotor members have pockets formed therein in which rollers 40*a*–40*d* respectively are freely mounted for rotation along with their respective rotors as described in my application Ser. No. 446,662. The rotors are rotatably driven by means of associated flexible drive shaft 26*a*–26*d* respectively, each of these drive shafts being driven by a respective motor 20*a*–20*d*. Circular stand off members 49 are provided on the shafts to keep the shafts relatively centered within their tubular bar members.

Each of the shafts 26*a*–26*d* has a respective gear 22*a*–22*d* fixedly attached thereto these gears intermeshing to maintain a desired relative phasing between the oscillator rotors. The drive shafts 26*a*–26*d* are preferably made hollow to provide a lubrication tube for use in providing lubrication to the oscillators. The motors 20*b* and 20*d* which drive shafts 26*b* and 26*d* are rotated in a direction opposite to that of the motors 20*a* and 20c which drive shafts 26*a* and 26*c*, with the gear train provided by gears 22*a*–22*d* maintaining the desired phase relationship between the various rotors. It has been found in many instances that it is possible to dispense with these phasing gears with the bars operating in resonance with high accoustical "Q", in which case the elastic bars tend to lock into synchronism without the need for the gearing. It has also been found that with a high accoustical "Q" system, synchronous wave action for multiple bars can be achieved without having an oscillator in every bar; the bars not being driven by oscillators vibrating in sympathetic relationship, with the energy generated in the oscillator driven bars being elastically coupled to the bars that do not have oscillators of their own.

Figures 4, 4A:
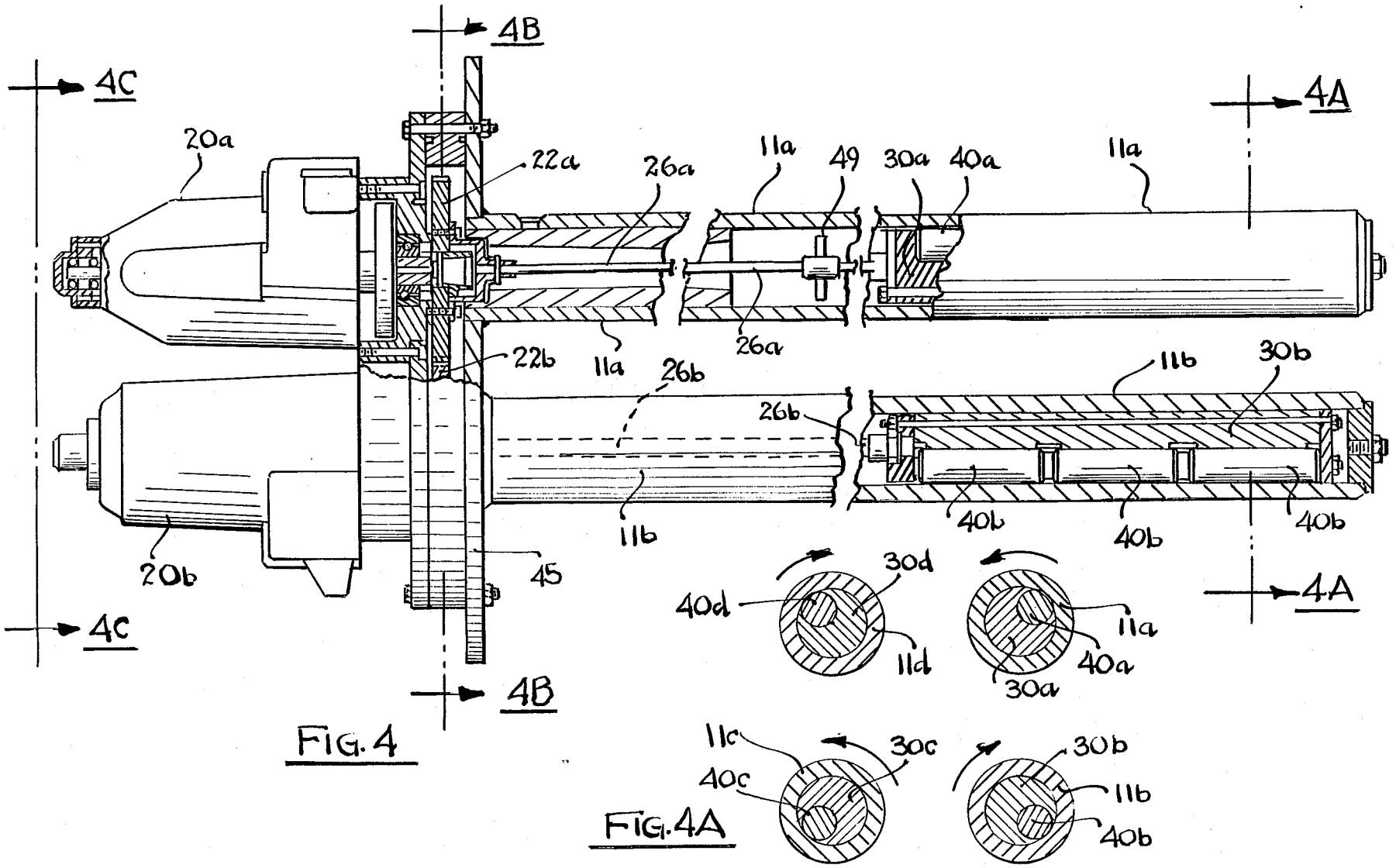
FIG. 4 is a side elevational view partly in cross section of a second embodiment of the invention.
FIG. 4A is a cross sectional view taken along the plane indicated by 4A—4A in FIG. 4.
Figure 4C:
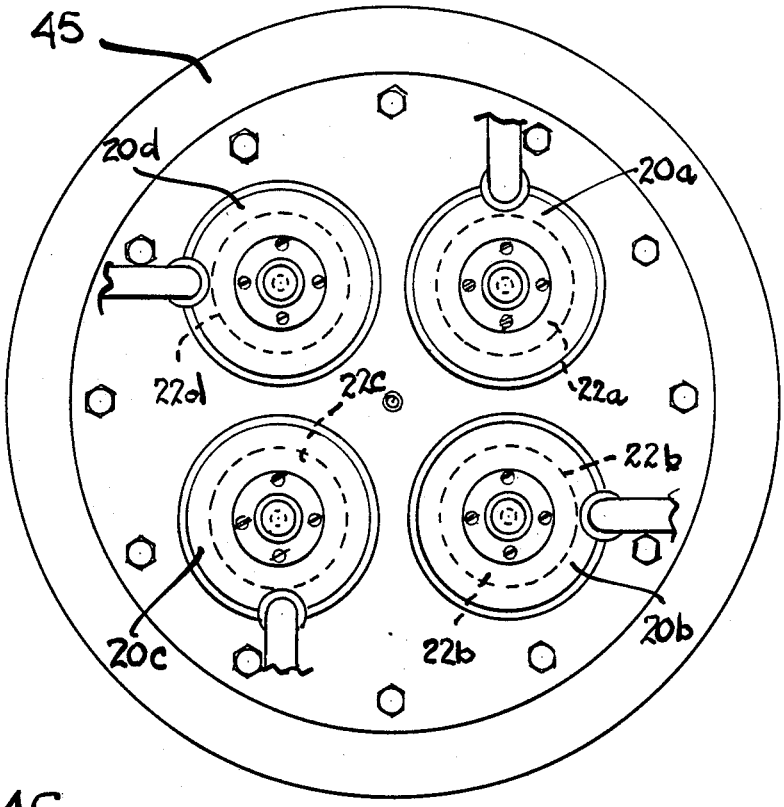
FIG. 4C is a view taken along the plane indicated by 4C—4C in FIG. 4.
Figure 4B:
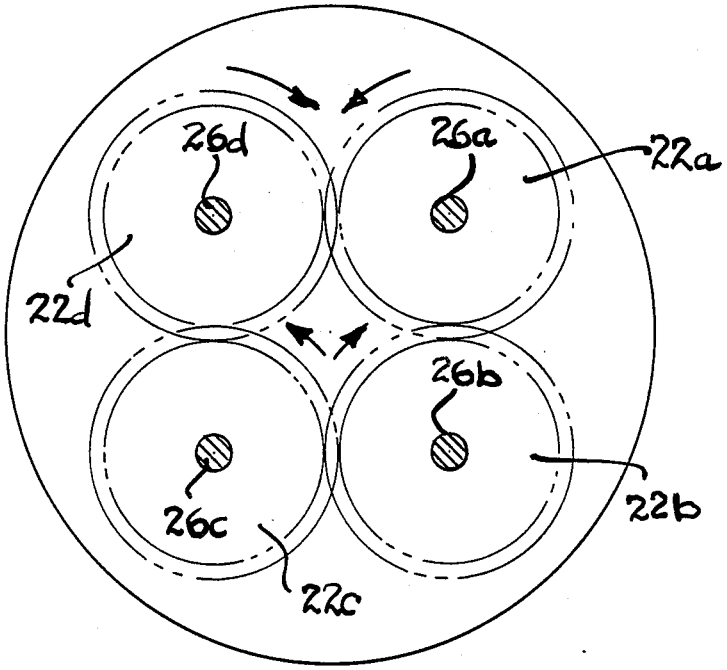
FIG. 4B is a cross sectional view taken along the plane indicated by 4B—4B in FIG. 4.

Referring to FIG. 4A, it will be seen that the phasing may be such that the four bars simultaneously bend around and toward the center and then away from the center in the manner of the petals of a flower blossom opening and closing. This provides particularly strong acoustic coupling to the liquid body in the center region.

Figure 5A:
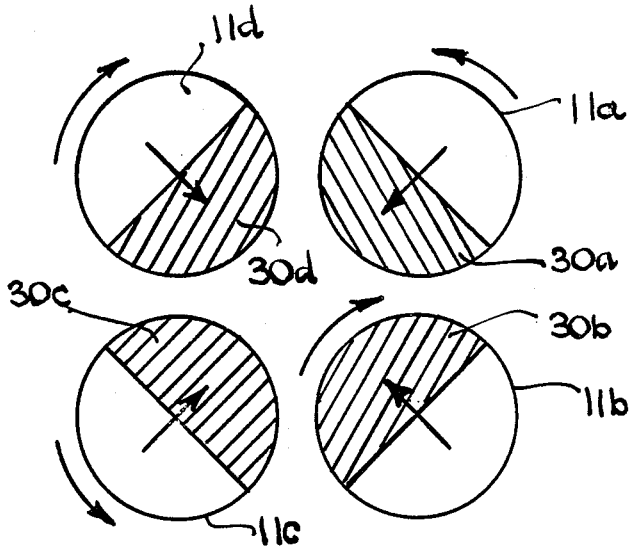
FIGS. 5A–5C are a series of schematic drawings illustrating the phasing of the rotors in the embodiment of FIG. 4.
Figure 5B:
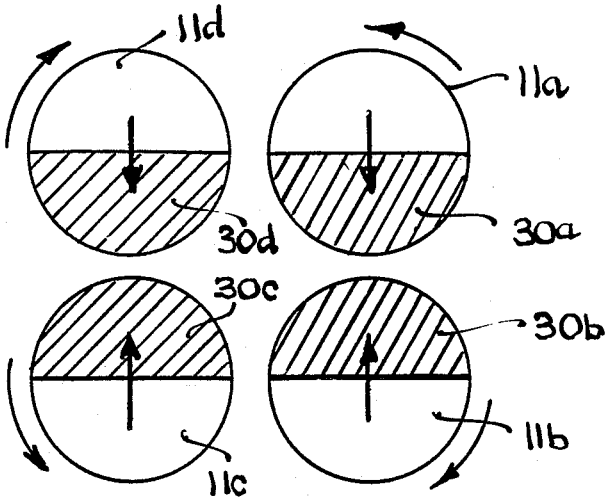
Figure 5C:
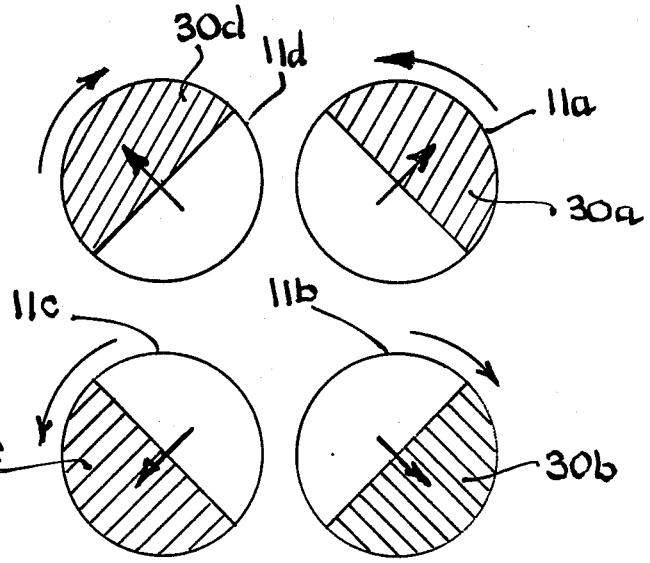

Referring now to FIGS. 5A–5C a series of schematic drawings are shown which further illustrate the operation of the phased rotors in the embodiment of FIG. 4. As shown in FIG. 5A the oscillator rotors are phased so that in this portion of the rotation cycle all the bar members are starting to move radially inwardly towards each other. In the portion of the cycle shown in FIG. 5B, pairs of bar members 11*a* and 11*b* and 11*c* and 11*d* have been urged towards each other; while in the portion of the cycle shown in FIG. 5C all four bar members are being urged away from each other. This cyclic pattern is not unlike flower blossom petals. This provides a cyclical squeezing or pinching action on the liquid in the central area between the bar members in a cyclical fashion to achieve the above mentioned high energy density field between the bar members.

While the invention has been described and illustrated in detail, it is to be clearly understood that this is intended by way of illustration and example only and is not to be taken by way of limitation, the spirit and scope of the invention being limited only by the terms of the following claims.

I claim:

1. A sonic agitator system for mixing fluid material comprising:

at least three similar hollow elastic bar members joined together at one end thereof with their longitudinal axes in substantially parallel relationship to each other, each of said bar members having an unbalanced rotor rotatably mounted therein, and means for rotatably driving said rotors to generate sonic vibrational energy in said bar members, said rotors being vibrationally phased relative to each other to generate an omnidirectional vibration pattern around said bar members and to substantially effect the cancellation of sonic energy at the location where the bar members are joined together such that the bar members are substantially quiescent at said location.

2. The sonic agitator of claim 1 wherein said bar members include two pairs thereof, said rotors being phased relative to each other so that the rotors of one pair of said rotors are being urged towards each other while the roors of other pair are being urged away from each other to provide a successive pinching action on the fluid material between the rotor pairs.

3. The sonic agitator of claim 1 wherein the means for driving said rotor comprises a single motor and a gear train coupled to said motor and to each of said rotors.

4. The sonic agitator of claim 1 wherein the means for driving said rotors comprises a separate motor for driving each of said rotors, said rotors being intercoupled by a gear train to assure the desired phasing between said rotors.

5. The sonic agitator of claim 2 wherein said rotors comprise similar half moon shaped weighted members, one rotor of each pair thereof being driven in a first direction, the other rotor of each pair thereof being driven in a direction opposite to said one direction.

6. The sonic agitator of claim 1 wherein said rotors and bar members are phased relative to each other so as to vibrate simultaneously toward and away from the center in the manner of the petals of a flower blossom.

* * * * *